United States Patent [19]

Folk

[11] 4,043,004

[45] Aug. 23, 1977

[54] RETRACTING TOOTH PROCESSING CYLINDER APPARATUS

[75] Inventor: Craig L. Folk, New Orleans, La.

[73] Assignee: The United States of America as represented by the Secretary of Agriculture, Washington, D.C.

[21] Appl. No.: 656,031

[22] Filed: Feb. 6, 1976

[51] Int. Cl.[2] ..... D02J 7/00

[52] U.S. Cl. ..... 19/200; 19/97; 19/96; 19/128

[58] Field of Search ..... 19/128, 105, 106 R, 19/204, 205, 200, 96, 97; 241/194, 192

[56] References Cited

U.S. PATENT DOCUMENTS

| | | | |
|---|---|---|---|
| 42,127 | 3/1864 | Taylor | 19/106 R |

FOREIGN PATENT DOCUMENTS

| | | | |
|---|---|---|---|
| 128,791 | 11/1928 | Switzerland | 19/96 |
| 207,569 | 2/1940 | Switzerland | 19/96 |
| 780 | 1886 | United Kingdom | 19/105 |
| 1,070 | 1863 | United Kingdom | 19/106 R |
| 807,515 | 1/1959 | United Kingdom | 19/205 |
| 167,945 | 7/1965 | U.S.S.R. | 19/105 |

*Primary Examiner*—Dorsey Newton
*Attorney, Agent, or Firm*—M. Howard Silberstein; David G. McConnell; Salvadore J. Cangemi

[57] ABSTRACT

An apparatus and method of processing textile stock to achieve cleaning and opening by use of a retracting tooth processing cylinder is disclosed. Self doffing is achieved by means of each tooth folding from a positive rake to a negative rake and eventually disappearing to the surface of a rotating cylinder during each cycle of rotation.

6 Claims, 3 Drawing Figures

RETRACTING TOOTH PROCESSING CYLINDER APPARATUS

The instant invention relates to an apparatus and method for opening textile stock using a high positive rake toothed cylinder and eliminating the requirement for doffing. More specifically, the invention relates to an improved processing cylinder wherein retracting teeth are pivoted in such a manner so as to extend from the face of a rotating cylinder only during the work performing portion of time interval. The teeth are retracted during the remaining portion of cylindrical rotation. This is accomplished by means of a unique application of a stationary internal cam and centrifugal force acting upon unbalanced movable teeth.

Heretofore, textile processing cylinders which use positive rake in the opening and cleaning apparatus have relied upon either adjacent cylinders to remove the open tufts and fibers prior to doffing or use air flow or some mechanical device such as an air brush. Straight tooth (zero rake) or cylinders with a slight negative rake have been used in applications where doffing is not possible. Such cylinders are known as self stripping or doffing cylinders and must rotate at high speed for proper functioning. All these applications and arrangements result in a detrimental turbulent air movement and high rotational speeds since it is necessary that the opening cylinder and associated equipment be enclosed. Therefore, a means of removing or managing the air must be provided.

The elimination of the necessity of handling the detrimental air movement is the precise discovery of the instant invention thereby resulting in opening and cleaning textile fiber efficiently. The separation of dirt and leaf trash from fibers and tufts can be accomplished in a still air environment by the differences in their mass-to-volume ratio. The teeth of the opening cylinder comb the feed stock so that dirt and trash are removed by falling free. The fibers and tufts are then carried by the teeth and dropped beyond the trash collection hopper into a suitable chute or onto an apron for further processing. Since the instant invention eliminates the carry-around air normally associated with conventional opening cylinders, no dirt and trash is blown back into and mixed with the opened fibers.

Therefore, it is the primary object of this invention to provide a textile opening cylinder with retracting teeth.

It is another object of this invention to eliminate excess air turbulence surrounding the processing cylinder.

It is a third object of this invention to provide an efficient means of separating dirt and leaf trash from fiber and tufts.

It is a fourth object of this invention to provide a means of positioning the point at which the teeth of the cylinder are fully extended or retracted.

It is a fifth object of this invention to provide an efficient air seal between the surface of the cylinder and a cover or shroud.

It is the sixth object of this invention to provide an opening cylinder with positive rake teeth that require no doffing.

Other objects and advantages of this invention will become further apparent hereinafter and in the drawings in which.

Figure 1:
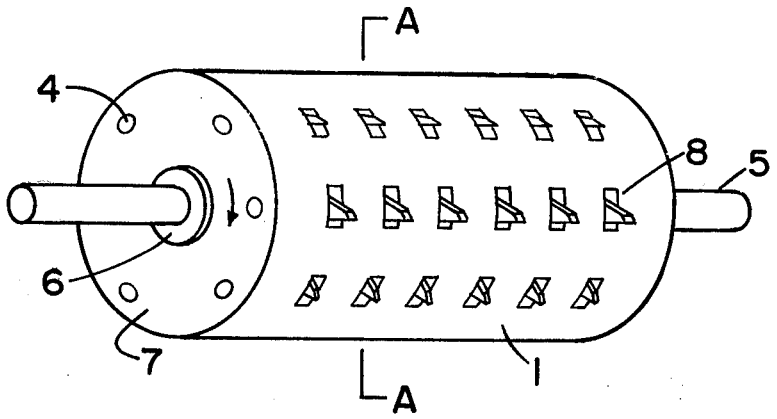
FIG. 1 is an isometric drawing showing a retracting tooth processing cylinder.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

Figure 2:
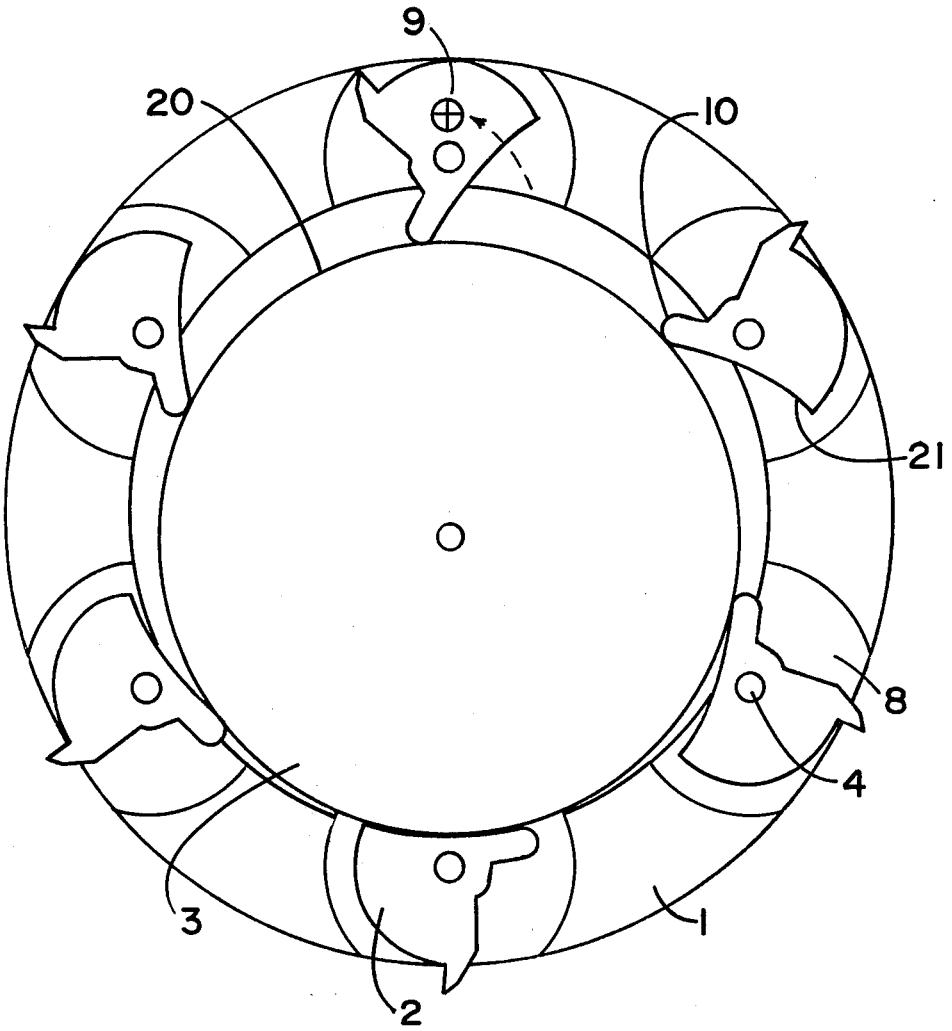
FIG. 2 is a cross-section of the cylinder showing the stationary internal cam and teeth taken along line A-A of FIG. 1.

Turning now to one embodiment of the invention illustrated in the drawings in which the teeth of the processing cylinder are extended and retracted each turn of the cylinder, processing cylinder 1 shown in FIGS. 1 & 2, is substantially a hollow sleeve with sufficient thickness to cage teeth 2, and has a plurality of slots 8 of sufficient width and length to allow teeth 2 to rotate about pin 4 freely. Within hollow cylinder 1 is a cam 3 which extends the inside length of cylinder 1 and is fixed between end caps 7. Cam 3 is supported by shaft 5 at each end, which is affixed to a suitable structure (not shown) for support. Incorporated in end caps 7 of cylinder 1 are bearings 6 which allow cylinder 1 to freely rotate about stationary cam 3. Cylinder 1 is driven in the direction indicated by a pulley or gear drive system (not shown).

Bearings 6 ride on shaft 5 which is attached to stationary cam 3. However shaft 5 is affixed to cam 3 critically off-center to allow differential spacing between cam 3 and cylinder 1 and producing positive movement of teeth 2 during working and retraction time intervals. Pins 4 act both as a journal for teeth 2 and a retainer for end caps 7. Cam 3 within cylinder 1 is positioned so that teeth 2 are forced to extend through slots 8 at a point where work is intended to be performed. When cylinder 1 is being rotated, the center of gravity, point 9 of teeth 2 (FIG. 2), cause each tooth 2 to rotate about pin 4 by centrifugal force. Tooth return arm 10 limits the travel of tooth 2 by cam 3. Arm 10 drives tooth 2 back to the extended position as it rides upon surface 20 of cam 3. Surface 20 of cam 3 matches curvature 21 of the inter-face of tooth 2 at the fully extended position, thus locking tooth 2 at the point where it is intended to perform work. Thus the critical functions of opening and cleaning of the tufts can be accomplished by correctly defining the dimensions of cylinder 1 in relation to cam 2 which is critically off set on shaft 5 to produce the proper working interval of traction and retraction of teeth 2 resulting from rotation of cylinder 1 at a critically set speed. The speed of rotation of cylinder 1 is determined by the volume and flow of cotton in the process.

Figure 3:
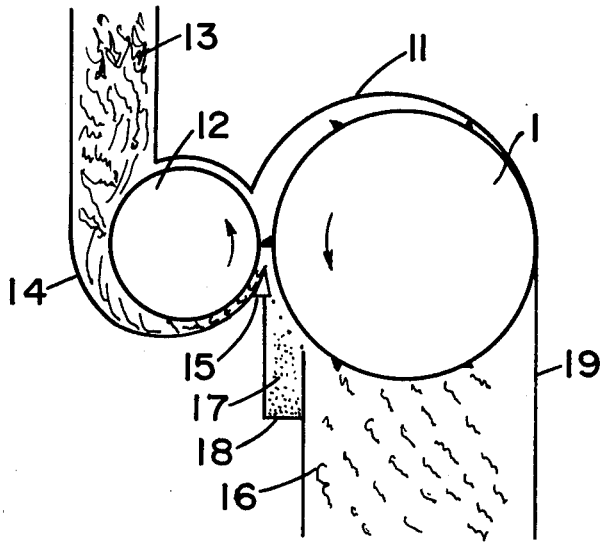
FIG. 3 is a diagramatic view of the processing cylinder in a typical opening application.

The instant invention can be demonstrated by FIG. 3 which embodies the retracting tooth processing cylinder in a textile opening and cleaning mode of operation. Referring to FIG. 3, cylinder 1 is surrounded by shroud 11 and in substantially horizontal proximity to feed roller 12. Feed roller 12 draws textile raw stock 13 through feed chute 14 up to pressure plate 15 where it is combed and opened by teeth 2 of cylinder 1 as described supra. As the opened fibers 16 are extracted, the dirt and/or leaf trash 17 falls into trash collection hopper 18 located adjacent to and below the rotatable cylinder. Teeth 2 are extended long enough to transport fibers 16 to chute 19. Teeth 2 are fully retracted by the time they arrive at shroud 11. Shroud 11 and cylinder 1 are in close proximity at this point to form an air seal. Therefore, any air that may be generated by cylinder 1 is not carried around. This lack of carry-around air is responsible for the efficient separation of trash 17 from fibers 16.

Having thus described my invention I claim:

1. An apparatus for opening and cleaning textile stock comprising the following:

a. a horizontal rotatable retractable tooth cylinder comprising in combination:
   1. a stationary cam;
   2. a rotatable cylinder, said cylinder housing said stationary cam;
   3. a plurality of teeth caged by said rotatable cylinder each tooth comprising:
      a. a working part to comb textile stock;
      b. a return arm which rides the surface of the cam and limits the travel of the tooth;
      c. an inside peripheral surface of each tooth which critically matches the surface of the cam thus forming an interface between said inside peripheral surface of said tooth and said surface of said cam;
   4. said plurality of teeth caged in a plurality of slots in said rotatable cylinder, each slot caging an individual tooth, and said teeth designed to turn freely on a pin,
   5. said pin acting as a journal or pivot for each tooth;
   6. said pin also acts as a retainer for a set of end caps which are retained by said pins and close the ends of the rotatable retractable tooth cylinder, each end cap comprising in combination:
      a. a bearing in the center of said end cap to allow for rotational movement;
   7. a shaft affixed to the ends of the stationary cam, said shaft passing through and supported by said bearing in said end caps, said shaft off-set equally on each end from the center of the cam thereby producing the desired critical interval or working conditions resulting from the outer rotational cylinder turning around the stationary internal cam and the freely turning teeth rotating on the pivot pin thus resulting in protraction and retraction of the teeth into and out of the rotatable cylinder slots as the tooth return arm and the critical tooth peripheral surface rides the outer surface of the stationary cam;

b. a horizontal feed roller and a pressure plate, in substantial horizontal proximity to said horizontal rotatable retractable tooth cylinder;

c. a feed chute, which deposits textile stock between said roller, said pressure plate, and said rotatable retractable tooth cylinder, where said textile stock is combined, opened, and extracted by said teeth of said rotatable retractable tooth cylinder;

d. a trash collection hopper into which trash falls from said opened textile stock, said hopper located adjacent to and below said rotatable cylinder to receive and collect said trash;

e. a chute into which said clean textile stock falls after being transported thereto by said retractable teeth and said retractable teeth retract.

2. The apparatus as defined in claim 1 wherein the plurality of slots is of sufficient length and width to allow for the working end of the teeth to protract and retract to a distance beyond the surface of the rotating cylinder and said distance is determined by the volume and flow of the textile stock to be processed.

3. The apparatus of claim 1 wherein the surface of the cam matches the curvature of the inter-face of the tooth at the fully extended position, thus locking the tooth at the point where it is intended to perform work.

4. The apparatus of claim 1 wherein the internal cam is positioned within the rotating cylinder so that the teeth are forced to extend through the slots at a point where work is intended to be performed.

5. The apparatus of claim 1 wherein the center of gravity of the teeth causes each tooth to rotate about the pin by centrifugal force.

6. The apparatus of claim 1 wherein the tooth return arm limits the travel of each tooth.

* * * * *